US005739484A

United States Patent [19]

Jones

[11] Patent Number: 5,739,484

[45] Date of Patent: Apr. 14, 1998

[54] EXHAUST MUFFLER

[76] Inventor: Mack L. Jones, MAC Products, Inc., 43214 Blackdeer Loop, #113, Temecula, Calif. 92590-3473

[21] Appl. No.: 820,418

[22] Filed: Mar. 12, 1997

[51] Int. Cl.[6] ..... F01N 1/08

[52] U.S. Cl. ..... 181/264; 181/270; 181/272; 181/273; 181/275

[58] Field of Search ..... 181/264, 265, 181/266, 268, 269, 270, 272, 273, 275, 276, 281, 282

[56] References Cited

U.S. PATENT DOCUMENTS 2,960,179 11/1960 Bryant ..... 181/268
4,574,914 3/1986 Flugger ..... 181/268
4,809,812 3/1989 Flugger ..... 181/268
4,909,347 3/1990 Wang ..... 181/272

*Primary Examiner*—Khanh Dang
*Attorney, Agent, or Firm*—Loyal McKinley Hanson

[57] ABSTRACT

An exhaust muffler includes a housing having a rectangularly shaped interior without fiberglass or other packing, an inlet tube on a first end portion of the housing for conveying exhaust gases to the interior, an outlet tube on an opposite second end portion of the housing for conveying the exhaust gases from the interior, and a baffle assembly within the interior for defining multiple different paths for exhaust gases to follow and two Helmholtz chambers for the exhaust gases to encounter as the exhaust gases flow through the interior of the housing from the inlet tube to the outlet tube. A central chamber flow path is provided that inhibits reverse flow.

11 Claims, 5 Drawing Sheets

EXHAUST MUFFLER

BACKGROUND OF THE INVENTION

1. Technical Field

This invention relates generally to exhaust mufflers for internal combustion engines, and more particularly to an exhaust muffler that provides better sound attenuation without significantly degrading engine performance.

2. Description of Related Art

Many exhaust mufflers are the type that includes some sort of baffle structure within an enclosure. The enclosure is commonly referred to as a muffler housing, and it includes an inlet and an outlet. Exhaust from a header pipe connected to the engine enters through the inlet, passes through and/or past the baffle structure, and then exits through the outlet to the tailpipe. As that occurs, accompanying sound is attenuated through restriction, reflection, and/or absorption.

Although existing muffler designs are effective in many respects, muffler-produced back pressure can be a problem. It tends to degrade engine performance, especially in high-performance racing cars. As a result, automotive designers, manufacturers, and users seek mufflers with improved sound-attenuation versus back-pressure characteristics, coupled with other desirable features of being compact, lightweight, and cost effective.

SUMMARY OF THE INVENTION

This invention addresses the need outlined above by providing an exhaust muffler having two main passageways or "flow paths." They combine with a central flow-through chamber to result in seven different paths for exhaust gases to follow, and two Helmholtz chambers for the exhaust gases to encounter, as the exhaust gases flow through the muffler housing. Unequal paths and the multiple reflections produced improve noise reduction with significantly less backpressure, while the structure of a central chamber inhibits reverse flow.

Sound waves are channeled through a series of baffles and reflector plates. There is no fiberglass packing. Left and right passageways provide two main flow paths for twice the flow and reflection area inside the muffler housing along seven different paths, while a central flow-through chamber produces a true anti-reversion muffler with less backpressure. Sound energy is reflected to control noise while allowing exhaust gases to flow freely through large dual flow paths, while the central structure of the baffle assembly accomplishes one-way flow for true anti-reversion that helps prevent reverse flow of acoustic and thermal energy. By redirecting and causing sound waves to collide, high-frequency sound is reduced without obstructing flow.

To paraphrase some of the claim language that is subsequently presented, an exhaust muffler constructed according to the invention includes a housing .having a rectangularly shaped interior without fiberglass or other packing. An inlet tube is located on a first or inlet end wall of the housing for conveying exhaust gases to the interior. An outlet tube is located an opposite second or outlet end wall for conveying the exhaust gases from the interior.

According to a major aspect of the invention, a baffle assembly is provided within the interior that defines two main passageways (i.e., flow paths) resulting in seven different paths for exhaust gases to follow, and two Helmholtz chambers for the exhaust gases to encounter, as the exhaust gases flow through the interior of the housing from the inlet tube to the outlet tube. The baffle assembly also includes a central structure that defines a central chamber flow-path that inhibits reverse flow. The following illustrative drawings and detailed description make the foregoing and other objects, features, and advantages of the invention more apparent.

DESCRIPTION OF THE PREFERRED EMBODIMENTS

Figure 1:
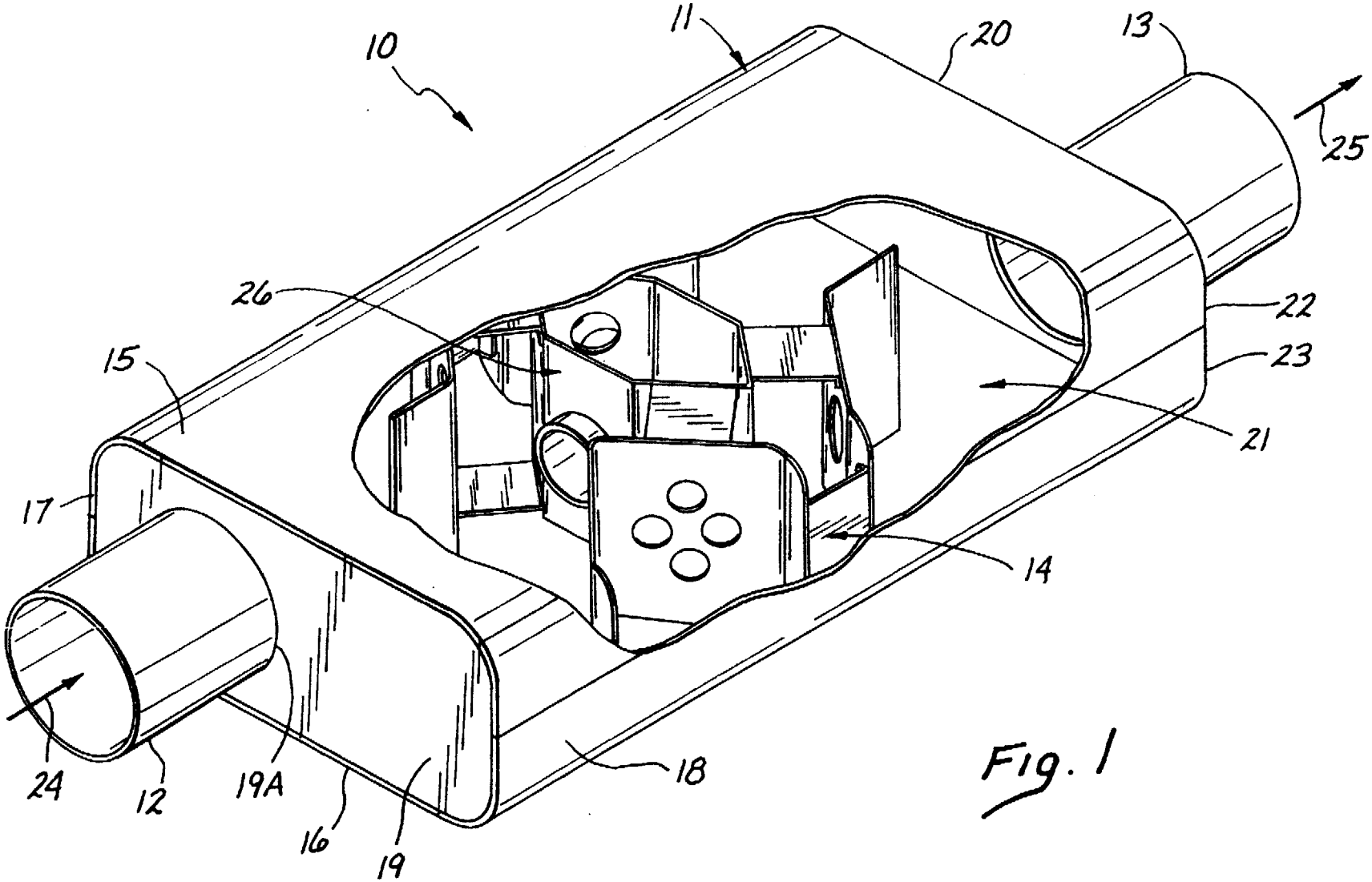
FIG. 1 of the drawings is a perspective view of an exhaust muffler constructed according to the invention, with portions of the housing broken away to reveal the baffle assembly within.
Figure 4:
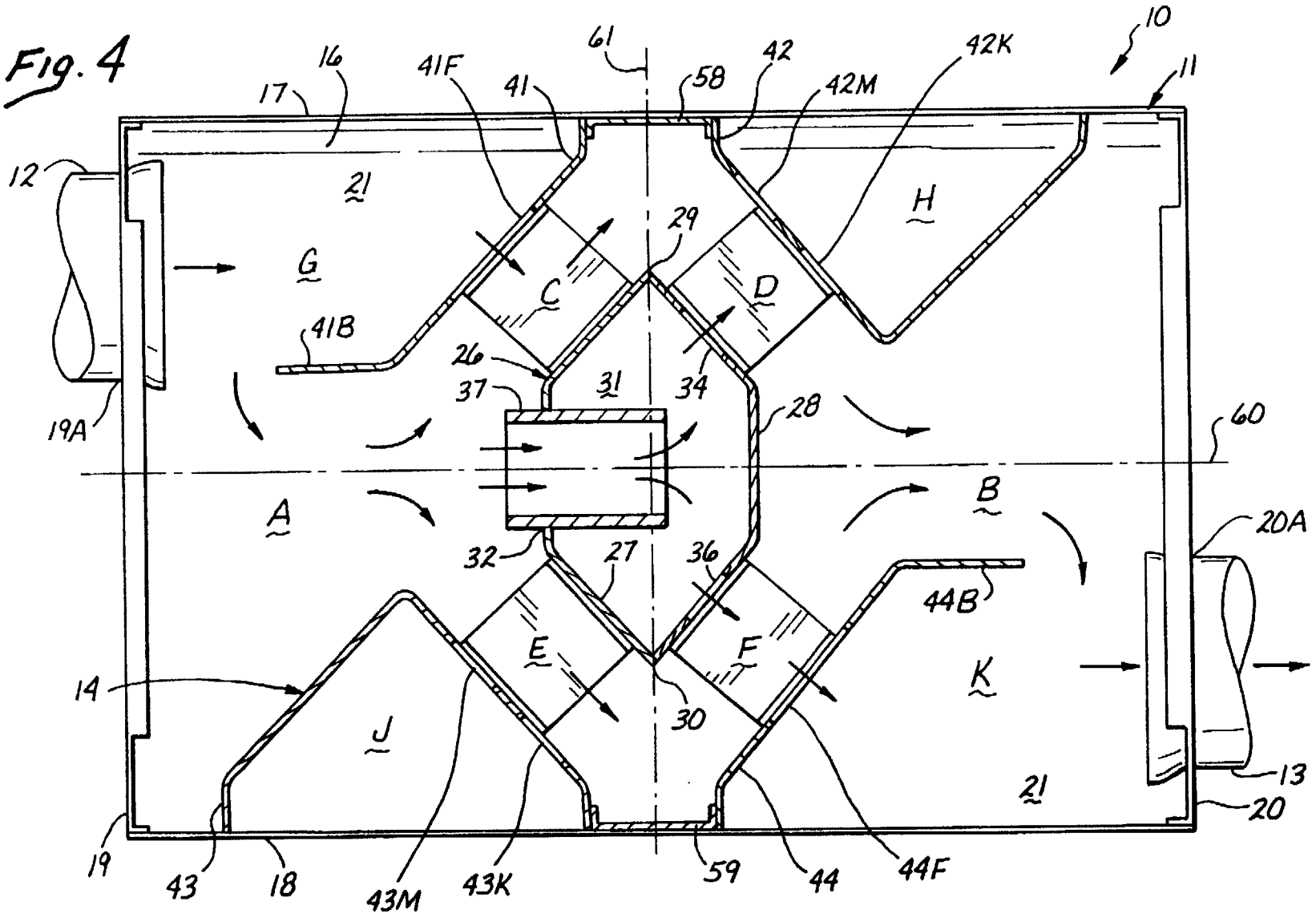
FIG. 4 is a top view of the muffler with the top half removed and the baffle assembly shown in cross section to illustrate the various paths exhaust gases take in flowing through the muffler.

The drawings show an exhaust muffler 10 constructed according to the invention. Generally, the muffler 10 includes a housing 11, a 2½-inch inside diameter inlet tube 12, a 2½-inch inside diameter outlet tube 13, and a baffle assembly 14 (FIGS. 1 and 4). Components are constructed of 1.2-mm thick AK metal (steel with 8 percent aluminum) that is given a high-temperature coating (HTS).

The housing 11 includes parallel top and bottom walls 15 and 16, parallel first and second side walls referred to as left and right side walls 17 and 18, and parallel first and second end walls referred to as inlet and outlet end walls 19 and 20. Together, the six walls 15–20 define an interior 21 of the housing 11. The inlet tube 12 is welded onto the inlet end wall 19 in a position extending to (preferably through) an inlet opening 19A that extends through the inlet end wall 19 (FIGS. 1 and 4). The outlet tube 13 is welded onto the outlet end wall 20 in a position extending to (preferably through) an outlet opening 20A that extends through the outlet end wall 20 (FIG. 4). A top half 22 of the housing 11 (a U-shaped component forming the top wall 15, a portion of the left side wall 17, and a portion of the right side wall 18) is welded to a mating U-shaped bottom half 23 of the housing 11 after the inlet and outlet end walls 19 and 20 and the baffle assembly 14 are welded to the bottom half 23.

As an idea of size, the illustrated housing 11 is about 13 inches long, 9 inches wide, and 3.75 inches high. Corresponding dimensions of the interior 21 are two wall thicknesses less. Of course, one of ordinary skill can vary those dimensions without departing from the scope of the claims in order to size the muffler for a particular application.

The inlet tube 12 functions as means on the housing 11 for conveying exhaust gases (e.g., from a header pipe or other external upstream component) to the interior 21 of the housing 11. The outlet tube 13 functions as means on the housing 11 for conveying the exhaust gases from the interior 21 (e.g., to a tailpipe or other external downstream component). Exhaust gases entering the housing 11 through the inlet tube 12 as depicted by an arrow 24 in FIG. 1, flow through the interior 21 (along multiple paths subsequently described) and out of the outlet tube 13 as depicted by an arrow 25 in FIG. 1.

Figure 2:
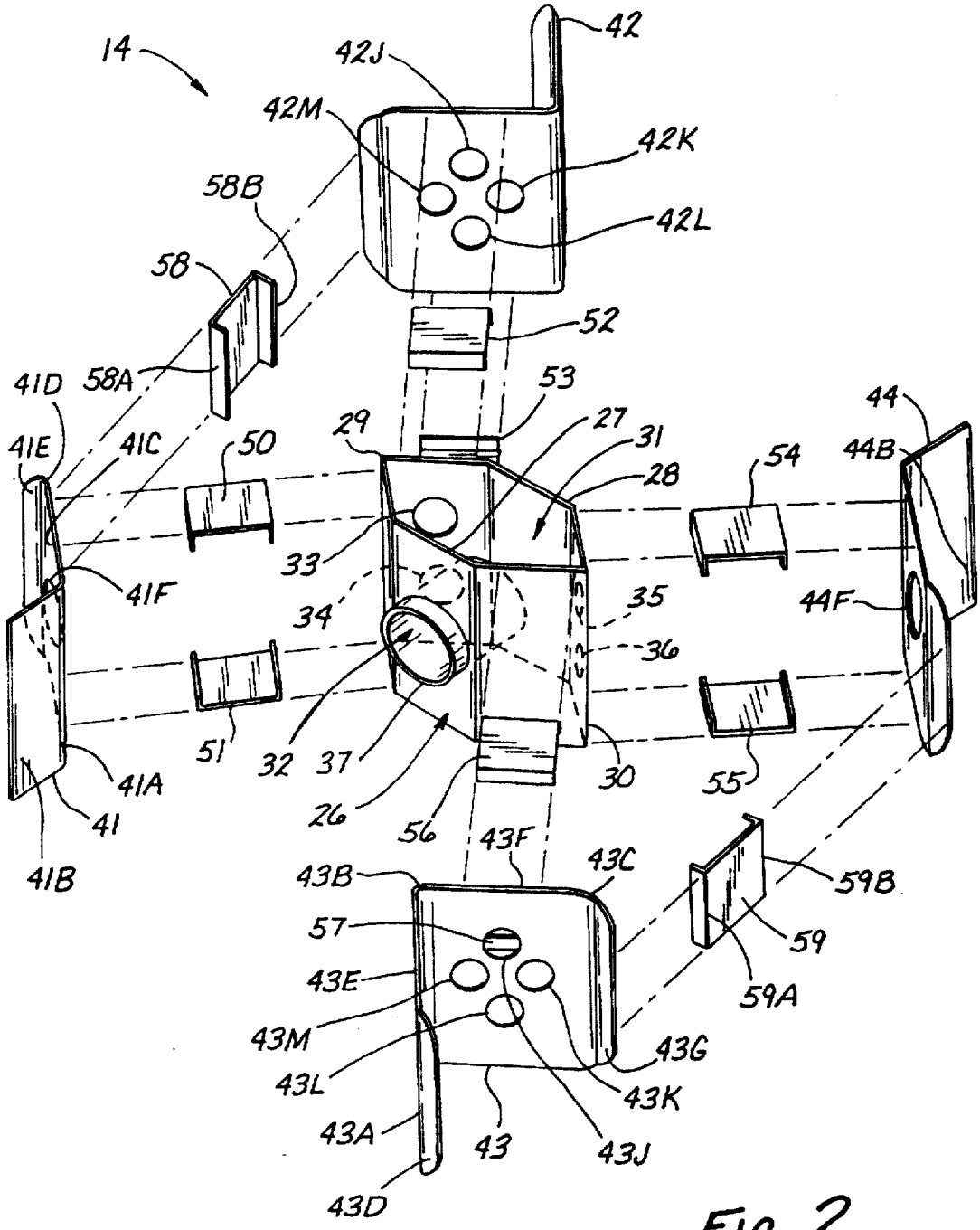
FIG. 2 is a disassembled view of the components making up the baffle assembly.
Figure 3:
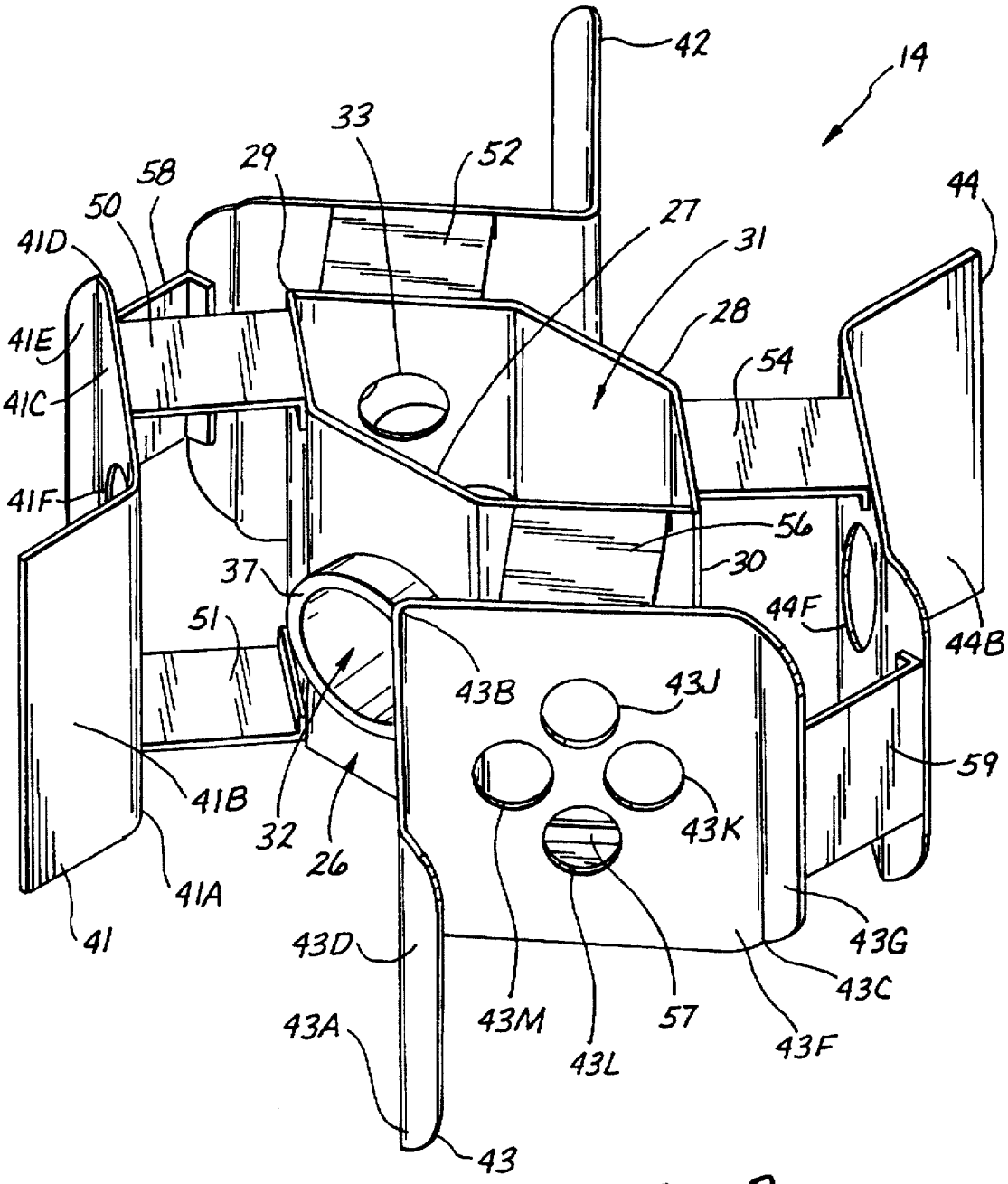
FIG. 3 is an enlarged view of the baffle assembly fully assembled.

FIG. 2 shows further details of the baffle assembly 14. The baffle assembly 14 includes a hexagonally shaped central structure 26 having six two-inch wide by 3.5-inch high sides (FIGS. 1–4). The 3.5-inch dimension extends between the top and bottom walls 15 and 16 when the muffler 10 is fully assembled. The central structure is formed by first making two 140-degree bends in each of first and second 6-inch by 3.5-inch baffle plates 27 and 28 so that each baffle plate has three panels or sides, and then by welding the two baffle plates 27 and 28 together along joints 29 and 30 (FIGS. 2 and 3). When fully assembled within the housing 11, the central structure 29 defines a central chamber 31 (FIGS. 2–4) that is described further on in this description with reference to FIG. 4.

A 1.5-inch diameter, centrally disposed opening 32 in the first baffle plate 27 (designated in FIGS. 3 and 4) provides an entranceway to the central chamber 31. Two 0.75-inch diameter holes 33 and 34 on a left side of the baffle plate 28 (FIG. 2) form a left exit from the central chamber 31; their centers are spaced apart 1.5 inches. Two 0.75-inch diameter holes 35 and 36 on a right side of the baffle plate 28 (FIG. 2) form a right exit from the central chamber 31; their centers are spaced apart 1.5 inches. A 2-inch long by 1.5-inch outside diameter tube 37 is welded to the baffle plate 27 in a position extending through the opening 32 so that about 1.5 inches of the tube 37 extends into the central chamber 31.

Four perforated plates 41–44 are connected to the central structure 26 with eight metal connectors 50–57. In addition, the first and second plates 41 and 42 are connected together with a connector 58, while third and fourth plates 43 and 44 are connected together with a connector 59. The connectors 50–59 are similar; each is 1.5 inches wide and 1.5 inches long between two 90-degree bends (e.g., bends 59A and 59B on the connector 59 in FIG. 2) that form two 0.25-inch wide tabs on each connector (e.g., tabs 58A and 58B on the connector 58 in FIG. 2). Appropriate ones of the tabs are welded onto the central structure 26 or the perforated plates 41–44 with the connectors in the various positions illustrated to form the assembled baffle assembly 14.

After the baffle assembly 14 is assembled, it is welded or otherwise suitable secured to the bottom half 22 of the housing 11. There, the baffle assembly 14 functions as means within the interior 21 of the housing 11 for defining multiple paths for the exhaust gases to follow and multiple Helmholtz chambers for the exhaust gases to encounter as the exhaust gases flow through the interior 21 from the inlet tube 12 to the outlet tube 13. With the baffle assembly 14 in place, the top half 21 of the housing 11 is welded or otherwise suitable secured onto the bottom half 22 of the housing 11 to form an air-tight enclosure. Preferably, the top half 21 of the housing 11 is provided with holes at appropriate places to enable the manufacturer to weld the baffle assembly 14 to the top half 21 of the housing 11 also. From the preceding and subsequent descriptions, one of ordinary skill in the art can use different fabrication techniques to construct a muffler within the scope of the claims.

Muffler design can be somewhat empirical in many respects, and it is found that the perforated plate design and placement described herein provide significantly improved performance. The perforated plates 41 and 44 are similar so that only the perforated plate 41 is described in further detail. Likewise, the perforated plates 42 and 43 are similar so that only the perforated plate 43 is described in further detail.

The perforated plate 41 measures about 3.5 inches high (between the top and bottom walls) and about 5.125 inches wide. A 130-degree first bend 41A in the perforated plate 41 (FIGS. 2 and 3), forms a 1.5-inch wide first panel 41B and a 3.125-inch wide second panel 41C. A 140-degree second bend 41D forms a 0.5-inch wide third panel 41E, and a 1.5-inch diameter opening 41F extends through the second panel 41C in a central location on the second panel 41C.

The perforated plate 43 measures 3.5 inches high and about 7.75 inches wide. As seen with reference to FIGS. 2 and 3, a 138-degree first bend 43A, a 84-degree second bend 43B, and a 138-degree third bend 43C, form a 0.5-inch wide first panel 43D, a 3.375-inch wide second panel 43E, a 3.875-inch wide third panel 43F, and a 0.5-inch wide fourth panel 43G. Four 0.75-inch diameter openings 43J, 43K, 43L, and 43M extend through the third panel 43F. The centers of the openings 43J and 43L are spaced apart 2.125 inches, and the centers of the openings 43K and 43M are spaced apart 2.1 inches.

FIG. 4 is a top view of the muffler 10 with the top half 22 removed in order to show the multiple paths the exhaust gases follow and multiple Helmholtz chambers the exhaust gases encounter as they flow through the interior 21 of the housing 11, from the inlet tube 12 through the interior 21 of the housing 11 to the outlet tube 13. Most of the baffle components within the housing 11 are in cross section, taken in suitable lateral planes parallel to the bottom wall 16 in order to expose important features. Portions of the inlet and outlet tubes 12 and 13 are removed to shorten them for illustrative convenience.

To facilitate the description of component placement within the housing 11, and the various flow paths and Helmholtz chambers, the interior 21 of the housing 11 is described as including four quarters. They are bounded by a longitudinally bisecting plane 60 and a transversely bisecting plane 61 (depicted by phantom lines in FIG. 4). The plane 60 extends longitudinally through the housing 11 perpendicular to the bottom wall 16 and midway between and parallel to the left and right side walls 17 and 18. The plane 61 extends transversely through the housing 11 perpendicular to the plane 60 and midway between the inlet and outlet end walls 19 and 20.

With the planes 60 and 61 so defined, the first quarter of the interior 21 is bounded by the planes 60 and 61, the inlet end wall 19, and the left side wall 17. The second quarter of the interior 21 is bounded by the planes 60 and 61, the outlet end wall 20, and the left side wall 17. The third quarter is bounded by the planes 60 and 61, the inlet end wall 19, and the right side wall 18, and the fourth quarter is bounded by the planes 60 and 61, the outlet end wall 20, and the right side wall 18.

To further facilitate description, the interior 21 is described as including an upstream region A of the interior 21 and a downstream region B of the interior 21 (FIG. 4). The upstream region A is disposed along the plane 60 in a position intermediate the central structure 26 and the inlet end wall 19. The downstream region B is disposed along the plane 60 in a position intermediate the central structure 26 and the outlet end wall 20.

As for the left and right passageways, the perforated plates 41 and 42 cooperate with the central structure 26 of the baffle assembly 14 to define a left passageway having an upstream portion C extending in the first quarter of the interior 21 between the upstream region A of the interior 21 and a position at the plane 61 proximate the left side wall 17. They also define a downstream portion D of the left passageway extending in the second quarter between the upstream portion C at the plane 61 and the downstream region B of the interior 21. Similarly, the perforated plates 43 and 44 cooperate with the central structure 26 of the baffle assembly 14 to define a right passageway having an upstream portion E extending in the third quarter of the interior 21 between the upstream region A of the interior 21 and a position at the plane 61 proximate the right side wall 18, and a downstream portion D of the right passageway extending in the fourth quarter between the upstream portion E at the plane 61 and the downstream region B of the interior 21.

Using the above definitions, the inlet tube 12 functions as means for conveying exhaust gases into the interior 21 at the first quarter of the interior 21. Similarly, the outlet tube 13 functions as means for conveying exhaust gases out of the interior 21 at the fourth quarter of the interior 21. In addition, the baffle assembly 14 includes multiple perforated plates 41–44 that cooperate with the central structure 26 to define the left and right passageways from the upstream region A of the interior 21 to the downstream region B.

Continuing to use the above definitions, the first perforated plate 41 is disposed angularly in the first quarter of the interior 21 and functions as means for cooperating with the left side wall 17 and the inlet end wall 19 to define an expansion space G proximate the inlet tube 12. The exhaust gases flow from the inlet tube 12 into the expansion space G. The first perforated plate 41 also functions as means for cooperating with the central structure 26 to define the upstream portion C of the left passageway, for defining the opening 41F that enables a portion of the exhaust gases to flow from the expansion space G directly into the upstream portion C of the left passageway, and for defining a path from the expansion space G toward the upstream region A of the interior 21 (said path being between the first panel 41B of the perforated plate 41 and the inlet end wall 19).

The second perforated plate 42 is disposed angularly in the second quarter of the interior 21 and functions as means for cooperating with the central structure 26 to define the downstream portion D of the left passageway. The second perforated plate 42 also functions as means for cooperating with the left side wall 17 to form a first Helmholtz chamber H along the downstream portion D. Four openings 42J, 42K, 42L, and 42M visible in FIG. 2 provide access to the first Helmholtz chamber H. Only the openings 42K and 42M are visible in FIG. 4. The first Helmholtz chamber H functions in a known way to attenuate noise.

The third perforated plate 43 is disposed angularly in the third quarter of the interior 21 and functions as means for cooperating with the central structure 26 to define the upstream portion E of the right passageway. The third perforated plate 44 also functions as means for forming a second Helmholtz chamber J along the upstream portion E. The openings 43J, 43K, 43L, and 43M visible in FIG. 2 provide access to the second Helmholtz chamber J. Only the openings 43K and 43M are visible in FIG. 4. The second Helmholtz chamber J also functions in a known way to attenuate noise.

The fourth perforated plate 44 is disposed angularly in the fourth quarter of the interior 21 and functions as means for cooperating with the right side wall 18 and outlet end wall 20 to define a collection space K proximate the outlet tube 13. The exhaust gases flow from the collection space K into the outlet tube 13. The fourth perforated plate 44 also functions as means for cooperating with the central structure 26 to define the downstream portion F, for defining an opening 44F (visible in FIGS. 2–4) that enables a portion of the exhaust gases to flow from the downstream portion F directly into the collection space K, and for defining a path from the downstream region F to the collection space K (said path being between a first panel 44B of the perforated plate 44 that is visible in FIGS. 2–4 and the outlet end wall 20).

In addition to the foregoing structural details, the first baffle plate 27 of the central structure 26 defines an entranceway (the opening 32) to the central chamber 31 that faces the upstream region A. The second baffle plate 28 of the central structure 26 defines the openings 33 and 34 visible in FIG. 2 that serve as a left exit from the central chamber 31 into the downstream portion D of the left passageway; only the opening 34 is visible in FIG. 4. The baffle plate 28 also defines the openings 35 and 36 visible in FIG. 2 that serve as a right exit from the central chamber 31 into the downstream portion F of the right passageway; only the opening 36 is visible in FIG. 2.

The tube 37 through the opening 32 in the first baffle plate 27 of the central structure 26 functions as means for enabling exhaust gases to flow from the upstream region A of the interior 21 through the entranceway 32 toward the left and right exits while inhibiting the exhaust gases from flowing in a reverse direction through the entranceway. The central structure 26 is symmetrical relative to the plane 60, but it is not symmetrical relative to the plane 61. The asymmetry produces a preferred direction of flow, toward the outlet region B.

The seven different flow paths provided in the muffler 10 by the baffle assembly 14 are identified by a series of arrows in FIG. 4. The first path proceeds from the inlet tube 12 to the expansion space G, and from there through the opening 41F in the first perforated plate 41 and into the upstream portion C of the left passageway. Then, it proceeds along the upstream portion C to the downstream portion D, and along the downstream portion D and past the first Helmholtz chamber H to the downstream region B of the interior 21. From the downstream region B, it proceeds to collection space K and then to the outlet tube 13.

The second path proceeds from the inlet tube 12 to the expansion space G, and from there to the upstream region A of the interior 21. From the upstream region A, it proceeds to the upstream portion C of the left passageway, along the upstream portion C to the downstream portion D of the left passageway, and along the downstream portion D and past the first Helmholtz chamber H to the downstream region B of the interior 21. From the downstream region B, it proceeds to the collection space K and then to the outlet tube 13.

The third path proceeds from the inlet tube 12 to the expansion space G, and from there to the upstream region A of the interior 21. From the upstream region A, it proceeds through the entranceway 32 and the tube 37 into the central chamber 31. From the central chamber 31 it proceeds through the left exit from the central chamber 31 into the downstream portion D of the left passageway, and along the downstream portion D and past the first Helmholtz chamber H to the downstream region B of the interior 21. From the downstream region B, it proceeds to the collection space K and then to the outlet tube 13.

The fourth path proceeds from the inlet tube 12 to the expansion space G, and from there to the upstream region A of the interior 21. From the upstream region A, it proceeds through the entranceway 32 and the tube 37 into the central chamber 31. From the central chamber 31 it proceeds through the right exit from the central chamber 31 into the downstream portion F of the right passageway, and along the downstream portion F to the downstream region B of the interior 21. From the downstream region B, it proceeds to the collection space K and then to the outlet tube 13.

The fifth path proceeds from the inlet tube 12 to the expansion space G, and from there to the upstream region A of the interior 21. From the upstream region A, it proceeds through the entranceway 32 and the tube 37 into the central chamber 31. From the central chamber 31 it proceeds through the right exit from the central chamber 31 into the downstream portion F of the right passageway, and through the opening 44F in the perforated plate 44 directly into the collection space K, and then to the outlet tube 13.

The sixth path proceeds from the inlet tube 12 to the expansion space G, and from there to the upstream region A of the interior 21. From the upstream region A, it proceeds to the upstream portion E of the right passageway, along the upstream portion E and past the second Helmholtz chamber J to the downstream portion F of the right passageway, and along the downstream portion F to the downstream region B of the interior 21. From the downstream region B, it proceeds to the collection space K and then to the outlet tube 13.

The seventh path proceeds from the inlet tube 12 to the expansion space G, and from there to the upstream region A of the interior 21. From the upstream region A, it proceeds to the upstream portion E of the right passageway, along the upstream portion E and past the second Helmholtz chamber J to the downstream portion F of the right passageway, and from there through the opening 44F in the perforated plate 44 directly into the collection space K, and then to the outlet tube 13.

Thus, the baffle assembly provides seven different paths for the exhaust gases to follow, and two Helmholtz chambers for the exhaust gases to encounter, as the exhaust gases flow from the inlet tube 12 to the outlet tube 13. That in combination with the anti-reversion central flow path results in multiple reflections and phase shifts that significantly attenuate noise with limited backpressure.

Figure 5:
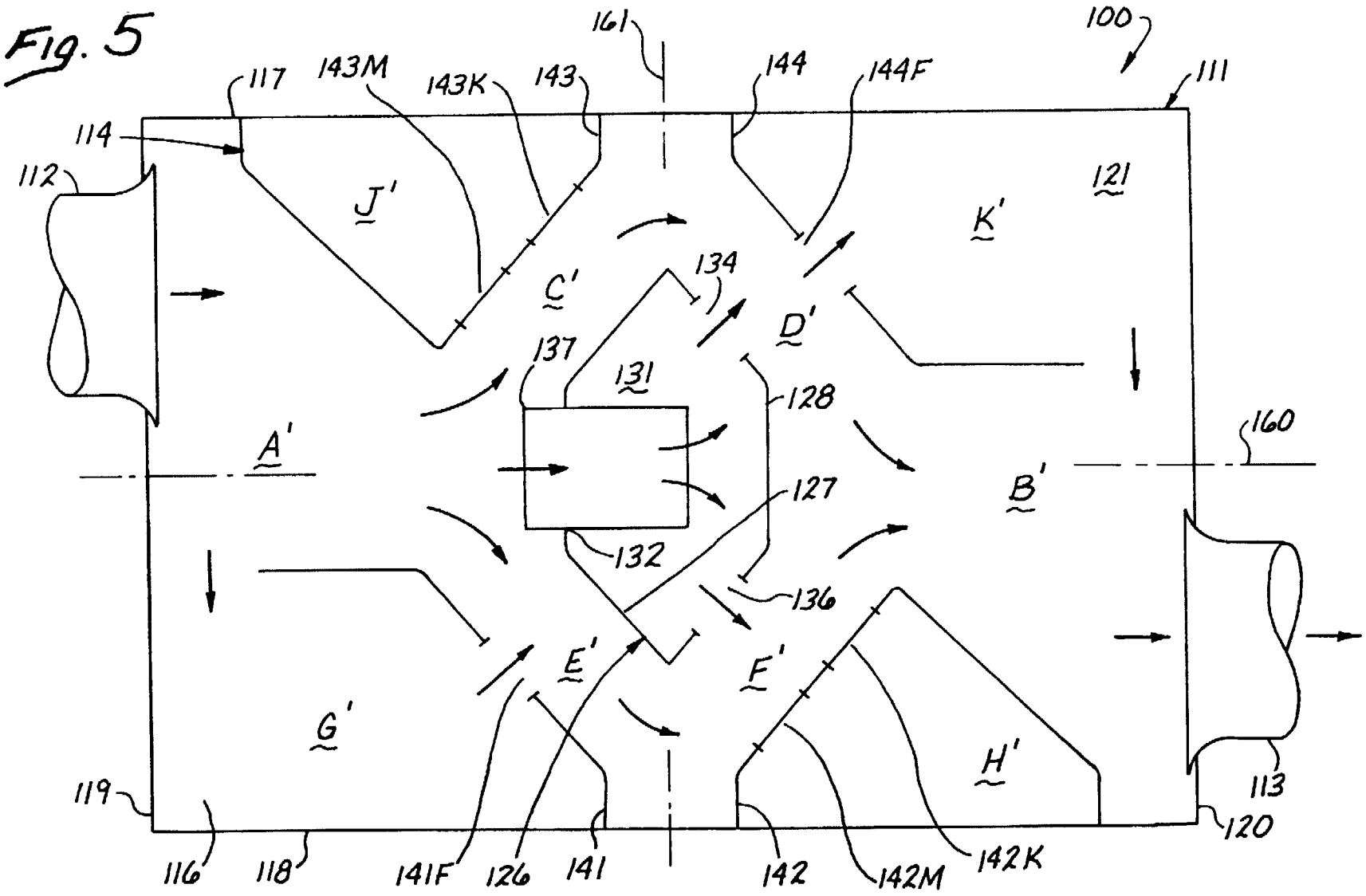
FIG. 5 is a diagrammatic top view of a second embodiment of the invention.

Now consider FIG. 5. It is a diagrammatic top view (similar to FIG. 4) of an exhaust muffler 100 constructed according to the invention. It may be fabricated, for example, by using the baffle assembly 14 described above after first rotating the baffle assembly 180 degrees before placing it in the muffler housing (rotated about an axis extending longitudinally through the baffle assembly 14). Many aspects of the muffler 100 are similar to the corresponding aspects of the muffler 10 and so only differences are described in further detail. For convenience, reference numerals designating parts of the muffler 100 are increased by one hundred over those designating corresponding parts of the muffler 10.

The muffler 100 includes a housing 111 with an interior 121, an inlet tube 112, an outlet tube 113, and a baffle assembly 114. The housing 111 includes a bottom wall 116, parallel first and second side walls referred to as left and right side walls 117 and 118, and parallel first and second end walls referred to as inlet and outlet end walls 119 and 120. The baffle assembly 114 defines left and right passageways, a first Helmholtz chamber H' accessible through openings 143K and 143M in perforated plate 143, and a second Helmholtz chamber J' accessible through openings 142K and 142M in perforated plate 142. The baffle assembly 114 includes a central structure 126 that defines a central chamber 131, an entranceway 132 to the central chamber with a tube 137 extending through it, a left exit 134 from the central chamber 131 to a downstream portion D' of the left passageway, and a right exit 136 from the central chamber 131 to a downstream portion F' of the right passageway.

A longitudinally bisecting plane 160 and a transversely bisecting plane 161 divide the interior 121 into four quarters. The first quarter of the interior 121 is bounded by the planes 160 and 161, the inlet end wall 119, and the left side wall 117. The second quarter of the interior 121 is bounded by the planes 160 and 161, the outlet end wall 120, and the left side wall 117. The third quarter is bounded by the planes 160 and 161, the inlet end wall 119, and the right side wall 118, and the fourth quarter is bounded by the planes 160 and 161, the outlet end wall 120, and the right side wall 118.

The seven different flow paths provided in the muffler 100 by the baffle assembly 114 are identified by a series of arrows in FIG. 5. The first path proceeds from the inlet tube 112 to the upstream region A' of the interior 121, with turbulence being produced by the plate 143 just ahead of the inlet tube 112. From there, it proceeds between the plate 141 and the inlet end wall 119 to the space G', through the opening 141F in the plate 141, and into the upstream portion E' of the right passageway. Then, it proceeds along the upstream portion E' to the downstream portion F', and along the downstream portion F' past the first Helmholtz chamber H' to the downstream region B' of the interior 121. From the downstream region B, it proceeds to the outlet tube 113.

The second path proceeds from the inlet tube 112 to the upstream region A'. From there, it proceeds to the upstream portion E' of the right passageway, along the upstream portion to the downstream portion F', along the downstream portion F' past the first Helmholtz chamber H' to the downstream region B', and from there to the outlet tube 113.

The third path proceeds from the inlet tube 112 to the upstream region A'. From there, it proceeds through the tube 137 in the entranceway 132 and into the central chamber 131. Then, it proceeds through the right exit 136 into the downstream portion F' of the right passageway, past the first Helmholtz chamber H', to the downstream region B', and from there to the outlet tube 113.

The fourth path proceeds from the inlet tube 112 to the upstream region A'. From there, it proceeds through the tube 137 in the entranceway 132 and into the central chamber 131. Then, it proceeds through the left exit 134 into the downstream portion D' of the left passageway, along the downstream portion D' to the downstream region B', and from there to the outlet tube 113.

The fifth path proceeds from the inlet tube 112 to the upstream region A'. From there, it proceeds through the tube 137 in the entraçeway 132 and into the central chamber 131. Then, it proceeds through the left exit 134 into the downstream portion D' of the left passageway, through the opening 144F in the perforated plate 144 and into the space K'. From there it proceeds between the plate 144 and the outlet end wall 120 to the downstream region B', and from there to the outlet tube 113.

The sixth path proceeds from the inlet tube 112 to the upstream region A'. From there, it proceeds to the upstream portion C' of the left passageway, along the upstream portion C' and past the second Helmholtz chamber J' to the downstream portion D' of the left passageway. From there, it proceeds along the downstream portion D' to the downstream region B', and from there to the outlet tube 113.

The seventh path proceeds from the inlet tube 112 to the upstream region A'. From there, it proceeds to the upstream portion C' of the left passageway, along the upstream portion C' and past the second Helmholtz chamber J' to the downstream portion D' of the left passageway. From there, it proceeds through the opening 144F in the perforated plate 144 into the space K'. From there it proceeds between the plate 144 and the outlet end wall 120 to the downstream region B', and from there to the outlet tube 113.

Thus, the muffler 100 also provides seven different paths, two Helmholtz chambers, and an anti-reversion central flow path for multiple reflections and phase shifts that significantly attenuate noise with limited backpressure. Although an exemplary embodiment has been shown and described, one of ordinary skill in the art may make many changes, modifications, and substitutions without necessarily departing from the spirit and scope of the invention. For example, one or both of the inlet and outlet tubes may be disposed closer to a central position on the end walls, and even be centrally located, without departing from the broader inventive concepts disclosed, instead of being disposed off center in the manner illustrated.

What is claimed is:

1. An exhaust muffler, comprising:

a housing, the housing having opposite top and bottom walls, opposite left and right side walls, and opposite inlet and outlet end walls that enclose an interior of the housing, the interior of the housing including a first quarter bounded by a longitudinally bisecting plane that extends longitudinally through the housing perpendicular to the bottom wall, a transversely bisecting plane that extends transversely through the housing perpendicular to the longitudinally bisecting plane, the inlet end wall, and the left side wall, the interior of the housing including a second quarter bounded by the bisecting planes, the outlet end wall, and the left side wall, the interior of the housing including a third quarter bounded by the bisecting planes, the inlet end wall, and the right side wall, and the interior of the housing including a fourth quarter bounded by the bisecting planes, the outlet end wall, and the right side wall;

means in the form of an inlet tube on the housing for conveying exhaust gases into the interior of the housing through an inlet opening in the inlet end wall of the interior;

means in the form of an outlet tube on the housing for conveying exhaust gases out of the interior of the housing through an outlet opening in the outlet end wall of the interior; and means in the form of a baffle assembly within the interior of the housing for defining multiple paths for exhaust gases to follow and multiple Helmholtz chambers for the exhaust gases to encounter as the exhaust gases flow through the interior of the housing from the inlet tube to the outlet tube;

wherein the baffle assembly includes a central structure extending between the top and bottom walls that defines a central chamber, and the baffle assembly includes multiple perforated plates extending between the top and bottom walls that define left and right passageways between the perforated plates and the central chamber, the left and right passageways extending from an upstream region of the interior that is disposed along the longitudinally bisecting plane in a position intermediate the central structure and the inlet end wall, to a downstream region of the interior that is disposed along the longitudinally bisecting plane in a position intermediate the central structure and the outlet end wall;

wherein the central structure defines an entranceway to the central chamber that faces the upstream region of the interior, a left exit from the central chamber into a downstream portion of the left passageway, and a right exit from the central chamber into a downstream portion of the right passageway, and the central structure includes means in the form of a tube extending through the entranceway for enabling exhaust gases to flow from the upstream region of the interior through the entranceway toward the left and right exits while inhibiting the exhaust gases from flowing in a reverse direction through the entranceway;

wherein the multiple perforated plates include means in the form of a first perforated plate disposed angularly in the first quarter of the interior for cooperating with the left side wall and inlet end wall to define an expansion space proximate the inlet tube, for cooperating with the central structure to define an upstream portion of the left passageway that extends in the first quarter between the upstream region of the interior and the downstream portion of the left passageway, for defining an opening enabling a portion of the exhaust gases to flow from the expansion space directly into the upstream portion of the left passageway, and for defining a path from the expansion space toward the upstream region of the interior;

wherein the multiple perforated plates include means in the form of a second perforated plate disposed angularly in the second quarter of the interior for cooperating with the central structure to define the downstream portion of the left passageway extending in the second quarter from the upstream portion of the left passageway to the downstream region of the interior, and for cooperating with the left side wall to form a first Helmholtz chamber along the downstream portion of the left passageway;

wherein the multiple perforated plates include means in the form of a third perforated plate disposed angularly in the third quarter of the interior for cooperating with the central structure to define an upstream portion of the right passageway that extends in the third quarter between the upstream region of the interior and the downstream portion of the right passageway, and for cooperating with the right side wall to form a second Helmholtz chamber along the upstream portion of the right passageway; and wherein the multiple perforated plates including means in the form of a fourth perforated plate disposed angularly in the fourth quarter of the interior for cooperating with the right side wall and outlet end wall to define a collection space proximate the outlet tube, for cooperating with the central structure to define the downstream portion of the right passageway extending in the fourth quarter from the upstream portion of the right passageway to the downstream region of the interior, for defining an opening enabling a portion of the exhaust gases to flow from the downstream portion of the right passageway directly into the collection space, and for defining a path from the downstream region of the interior to the collection space.

2. An exhaust muffler as recited in claim 1, wherein the baffle assembly defines just two Helmholtz chambers.

3. An exhaust muffler as recited in claim 1, wherein at least one of the inlet tube and the outlet tube has an inward end portion that is flared.

4. An exhaust muffler as recited in claim 1, wherein at least the first Helmholtz chamber includes an entranceway to the first Helmholtz chamber in the form of four 0.75-inch diameter openings in the second perforated plate.

5. An exhaust muffler as recited in claim 1, wherein at least one of the first and second exits from the central chamber includes two 0.75-inch diameter openings in the central structure.

6. An exhaust muffler as recited in claim 1, wherein the baffle assembly defines seven different paths and two Helmholtz chambers.

7. An exhaust muffler as recited in claim 6, wherein:

a first path of the seven different paths proceeds from the expansion space through the first perforated plate and into the upstream portion of the left passageway, along the upstream portion of the left passageway to the downstream portion of the left passageway, along the downstream portion of the left passageway to the downstream region of the interior, and from the downstream region of the interior to the collection space;

a second path of the seven different paths proceeds from the expansion space to the upstream region of the interior, from the upstream region to the upstream portion of the left passageway, along the upstream portion of the left passageway to the downstream portion of the left passageway, along the downstream portion of the left passageway to the downstream region of the interior, and from the downstream region of the interior to the collection space;

a third path of the seven different paths proceeds from the expansion space to the upstream region of the interior, from the upstream region through the entranceway to the central chamber and into the central chamber, from the central chamber through the left exit and into the downstream portion of the left passageway, along the downstream portion of the left passageway to the downstream region of the interior, and from the downstream region of the interior to the collection space;

a fourth path of the seven different paths proceeds from the expansion space to the upstream region of the interior, from the upstream region through the entranceway to the central chamber and into the central chamber, from the central chamber through the right exit and into the downstream portion of the right passageway, along the downstream portion of the right passageway to the downstream region of the interior, and from the downstream region to the collection space;

a fifth path of the seven different paths proceeds from the expansion space to the upstream region of the interior, from the upstream region through the entranceway to the central chamber and into the central chamber, from the central chamber through the right exit and into the downstream portion of the right passageway, and from the downstream portion of the right passageway through the fourth perforated plate into the collection space;

a sixth path of the seven different paths proceeds from the expansion space to the upstream region of the interior, from the upstream region to the upstream portion of the right passageway, along the upstream portion of the right passageway to the downstream portion of the right passageway, along the downstream portion of the right passageway to the downstream region of the interior, and from the downstream region of the interior to the collection space; and a seventh path of the seven different paths proceeds from the expansion space to the upstream region of the interior, from the upstream region to the upstream portion of the right passageway, along the upstream portion of the right passageway to the downstream portion of the right passageway, and from the downstream portion of the right passageway through the fourth perforated plate into the collection space.

8. An exhaust muffler as recited in claim 1, wherein the inlet tube is disposed intermediate the longitudinally bisecting plane and the left side wall and the outlet tube is disposed intermediate the longitudinally bisecting plane and the right side wall.

9. An exhaust muffler, comprising:

a housing, the housing having opposite top and bottom walls, opposite left and right side walls, and opposite inlet and outlet end walls that enclose an interior of the housing, the interior of the housing including a first quarter bounded by a longitudinally bisecting plane that extends longitudinally through the housing perpendicular to the bottom wall, a transversely bisecting plane that extends transversely through the housing perpendicular to the longitudinally bisecting plane, the inlet end wall, and the left side wall, the interior of the housing including a second quarter bounded by the bisecting planes, the outlet end wall, and the left side wall, the interior of the housing including a third quarter bounded by the bisecting planes, the inlet end wall, and the right side wall, and the interior of the housing including a fourth quarter bounded by the bisecting planes, the outlet end wall, and the right side wall;

means in the form of an inlet tube on the housing for conveying exhaust gases into the interior of the housing through an inlet opening in the inlet end wall;

means in the form of an outlet tube on the housing for conveying exhaust gases out of the interior of the housing through an outlet opening in the outlet end wall; and means in the form of a baffle assembly within the interior of the housing for defining multiple paths for exhaust gases to follow and multiple Helmholtz chambers for the exhaust gases to encounter as the exhaust gases flow through the interior of the housing from the inlet tube to the outlet tube;

wherein the baffle assembly includes a central structure extending between the top and bottom walls that defines a central chamber, and the baffle assembly includes multiple perforated plates extending between the top and bottom walls that define left and right passageways between the perforated plates and the central chamber, the left and right passageways extending from an upstream region of the interior that is disposed along the longitudinally bisecting plane in a position intermediate the central structure and the inlet end wall, to a downstream region of the interior that is disposed along the longitudinally bisecting plane in a position intermediate the central structure and the outlet end wall;

wherein the central structure defines an entranceway to the central chamber that faces the upstream region of the interior, a left exit from the central chamber into a downstream portion of the left passageway, and a right exit from the central chamber into a downstream portion of the right passageway, and the central structure includes means in the form of a tube extending through the entranceway for enabling exhaust gases to flow from the upstream region of the interior through the entranceway toward the left and right exits while inhibiting the exhaust gases from flowing in a reverse direction through the entranceway;

wherein the multiple perforated plates include means in the form of a first perforated plate disposed angularly in the third quarter of the interior for cooperating with the right side wall and inlet end wall to define a first space proximate the right side wall and inlet end wall, for cooperating with the central structure to define an upstream portion of the right passageway that extends in the third quarter between the upstream region of the interior and the downstream portion of the right passageway, for defining an opening enabling a portion of the exhaust gases to flow from the first space directly into the upstream portion of the right passageway, and for defining a path from the first space toward the upstream region of the interior;

wherein the multiple perforated plates include means in the form of a second perforated plate disposed angularly in the fourth quarter of the interior for cooperating with the central structure to define the downstream portion of the right passageway extending in the fourth quarter from the upstream portion of the right passageway to the downstream region of the interior, and for cooperating with the right side wall to form a first Helmholtz chamber along the downstream portion of the right passageway;

wherein the multiple perforated plates include means in the form of a third perforated plate disposed angularly in the first quarter of the interior for cooperating with the central structure to define an upstream portion of the left passageway that extends in the first quarter between the upstream region of the interior and the downstream portion of the left passageway, and for cooperating with the left side wall to form a second Helmholtz chamber along the upstream portion of the left passageway; and wherein the multiple perforated plates including means in the form of a fourth perforated plate disposed angularly in the second quarter of the interior for cooperating with the left side wall and outlet end wall to define a second space proximate the left side wall and outlet end wall, for cooperating with the central structure to define the downstream portion of the left passageway extending in the second quarter from the upstream portion of the left passageway to the downstream region of the interior, for defining an opening enabling a portion of the exhaust gases to flow from the downstream portion of the left passageway directly into the second space, and for defining a path from the downstream region of the interior to the second space.

10. An exhaust muffler as recited in claim 9, wherein:

a first path of the multiple different paths proceeds from the inlet tube, past the upstream region of the interior, between the first perforated plate and the inlet end wall to the first space, through the opening in the first perforated plate to the upstream portion of the right passageway, along the upstream portion of the right passageway to the downstream portion of the right passageway, along the downstream portion of the right passageway past the first Helmholtz chamber to the downstream region of the interior, and from the downstream region to the outlet tube;

a second path of the multiple different paths proceeds from the inlet tube to the upstream region of the interior, from the upstream region to the upstream portion of the right passageway, along the upstream portion of the right passageway to the downstream portion of the right passageway, along the downstream portion of the right past the first Helmholtz chamber to the downstream region of the interior, and from the downstream region to the outlet tube;

a third path of the multiple different paths proceeds from the inlet tube to the upstream region the interior, from the upstream region through the entranceway to the central chamber and into the central chamber, from the central chamber through the right exit to the downstream portion of the right passageway, along the downstream portion of the right passageway past the first Helmholtz chamber to the downstream region of the interior, and from the downstream region to the outlet tube;

a fourth path of the multiple different paths proceeds from the inlet tube to the upstream region the interior, from the upstream region through the entranceway to the central chamber and into the central chamber, from the central chamber through the left exit to the downstream portion of the left passageway, along the downstream portion of the left passageway to the downstream region of the interior, and from the downstream region to the outlet tube;

a fifth path of the multiple different paths proceeds from the inlet tube to the upstream region the interior, from the upstream region through the entranceway to the central chamber and into the central chamber, from the central chamber through the left exit to the downstream portion of the left passageway, from the downstream portion of the left passageway through the opening in fourth perforated plate into the second space, from the second space between the fourth perforated plate and the outlet end wall to the downstream region of the interior, and from the downstream region to the outlet tube;

a sixth path of the multiple different paths proceeds from the inlet tube to the upstream region the interior, from the upstream region to the upstream portion of the left passageway, along the upstream portion of the left passageway past the second Helmholtz chamber to the downstream portion of the left passageway, along the downstream portion of the left passageway to the downstream region of the interior, and from the downstream region to the outlet tube; and a seventh path of the multiple different paths proceeds from the inlet tube to the upstream region the interior, from the upstream region to the upstream portion of the left passageway, along the upstream portion of the left passageway past the second Helmholtz chamber to the downstream portion of the left passageway, from the downstream portion of the left passageway through the opening in fourth perforated plate into the second space, from the second space between the fourth perforated plate and the outlet end wall to the downstream region of the interior, and from the downstream region to the outlet robe.

11. An exhaust muffler as recited in claim 9, wherein the inlet tube is disposed intermediate the longitudinally bisecting plane and the left side wall and the outlet tube is disposed intermediate the longitudinally bisecting plane and the right side wall.

* * * * *